United States Patent [19]

Shutt

[11] 4,023,744

[45] May 17, 1977

[54] WINCH WITH CABLE TENSIONING DEVICE OPERABLE DURING REELING OUT AND REELING IN

[75] Inventor: Donald P. Shutt, Long Beach, Calif.

[73] Assignee: Western Gear Corporation, Lynwood, Calif.

[22] Filed: Apr. 19, 1976

[21] Appl. No.: 677,878

[52] U.S. Cl. ..... 242/54 R; 254/175.7

[51] Int. Cl.[2] ..... B65H 75/00

[58] Field of Search ..... 242/54 R; 254/150 R, 254/175.5, 175.7, 182, 187 R; 192/41 S, 71, 92; 74/345

[56] References Cited

UNITED STATES PATENTS

| | | | |
|---|---|---|---|
| 2,300,343 | 10/1942 | Clay | 242/54 R |
| 3,005,622 | 10/1961 | Garnler | 254/175.7 |
| 3,392,926 | 7/1968 | Adams | 242/54 R |
| 3,853,303 | 12/1974 | Wineburner | 254/150 R |
| 3,901,478 | 8/1975 | Peterson | 254/187 R |
| 3,915,433 | 10/1975 | Therkildsen | 254/187 R |

*Primary Examiner*—Edward J. McCarthy
*Attorney, Agent, or Firm*—Forrest J. Lilly

[57] ABSTRACT

The disclosure is of a system for maintaining tension in a cable during winding off or on a power driven cable drum. The cable winds off or back onto the cable drum over a roller means, e.g., between a pair of parallel geared-together traction rollers, or over a sheave, as another example, with a non-slip engagement therewith. The non-slip engagement avoids wear on the cable, and the life of the cable is greatly extended. To permit this, a frictional slip clutch is placed in a power transmission interposed between the power driven cable drum and the non-slip drive rollers, or sheave. The wear that formerly eroded the cable now occurs in the friction slip clutch, whose parts can always be quickly and inexpensively replaced. The system also includes certain one-way roller clutches, and gears, so arranged as to normally overdrive the roller means, or sheave, in paying out cable, and to retard the cable during winding in. The arrangement provides gearing of a drive ratio tending to overdrive the cable in paying out, and to underdrive, or retard, during winding in, the necessary slip always being accommodated by the slip-clutch. The cable is thus always under tension, and fouling of the cable is prevented.

7 Claims, 7 Drawing Figures

C
55
25
12
2
2
26
24
10
14
11
11

17
17
GEAR BOX
MOTOR
12
15
13
16
14
C
C
13
15
16
27
20
L
26
24
25
24
21

WINCH WITH CABLE TENSIONING DEVICE OPERABLE DURING REELING OUT AND REELING IN

FIELD OF THE INVENTION

This invention relates generally to cable winches or hoists, and particularly to devices for preventing fouling of wire cables wound on the drum thereof during either paying out or reeling in of the cable. The invention deals with applications in which the cable is to pay out or retrieve a load in a generally horizontal direction, or generally vertical direction, under light or no-load conditions.

BACKGROUND OF THE INVENTION

Devices have been used in the past for the purpose of keeping the cable tautened in the applications noted above, and these have involved use of roller or sheave means for pressural engagement with the cable to accomplish tautening of the cable outside of or beyond the drum. In all cases of which I am aware, however, there exists an inherent disadvantageous feature in that the cable is constrained to slip relative to the roller or sheave. This condition results in wear on the cable requiring its premature replacement. A primary purpose of the present invention is the reorganization of such systems to remove slip and wear from the cable and transfer it to one or more slip clutches, which can be replaced much more easily and less expensively than can be cable itself.

The invention itself can best be described through reference to the accompanying drawings showing selected present illustrative embodiments thereof.

Figure 3:
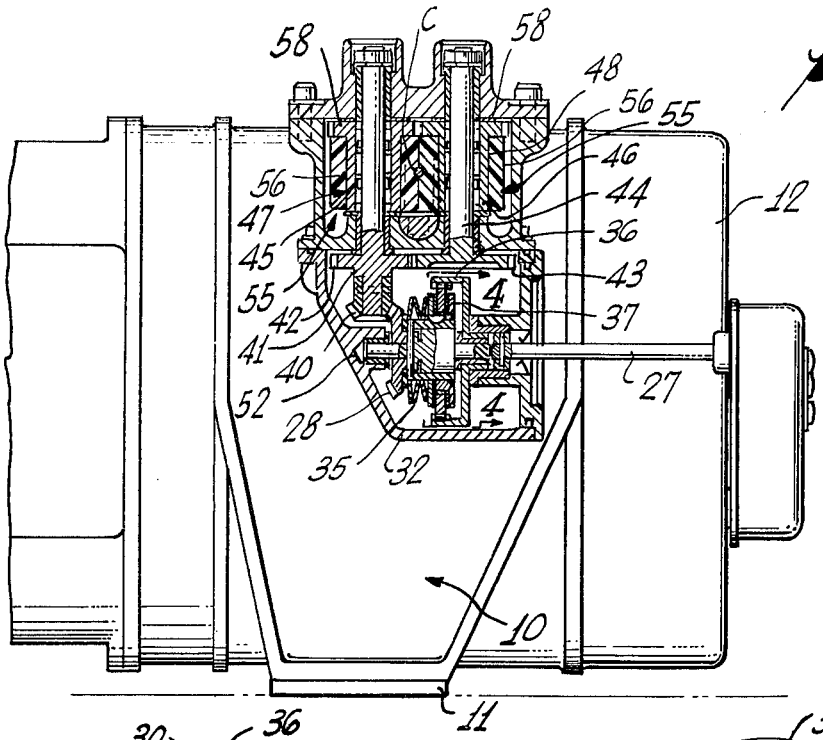
FIG. 3 is a side elevational view, with parts borken away, looking from the left in FIG. 1.
Figure 3A:
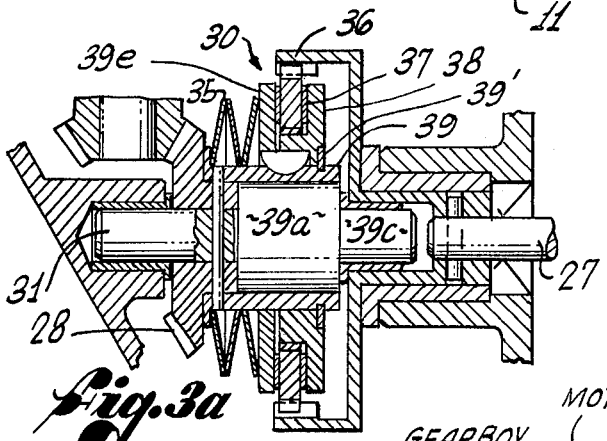
Figure 4:
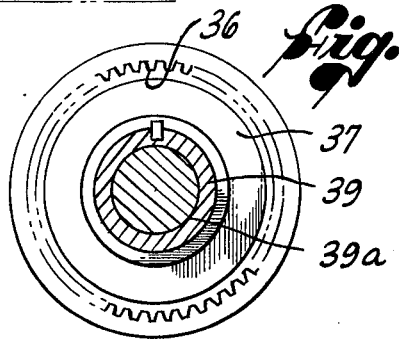
Figure 6:
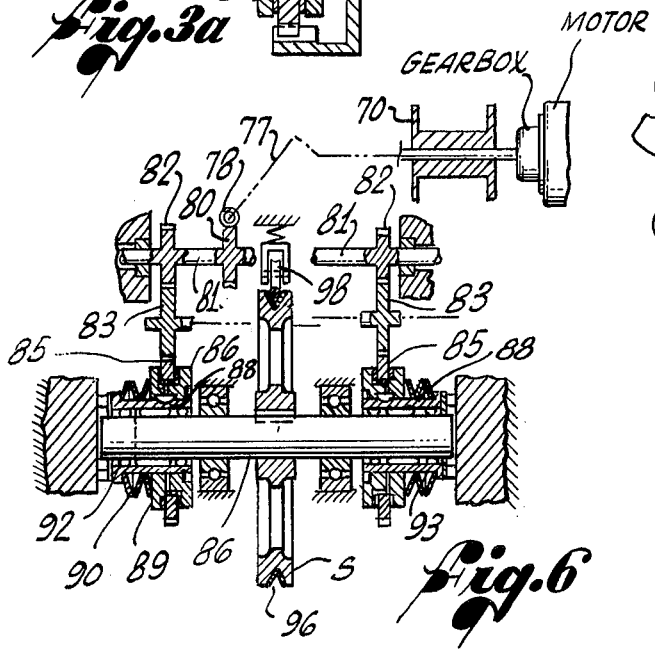
Figure 5:
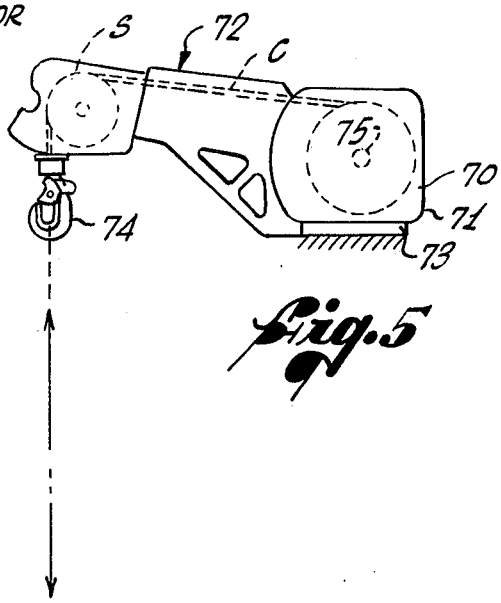

FIG. 3*a* is an enlarged view of a portion of FIG. 3;

FIG. 4 is a detail section on line 4—4 in FIG. 3;

FIG. 5 is a diagrammatic view of a modified application and form of the invention, applied in this case to a support boom, with a hoisting drum at its base, and a sheave at its extremity for receiving the cable from the hoisting drum, and paying it out downwardly, or retrieving it upwardly; and FIG. 6 is a diagrammatic representation, largely in section, of mechanism for use in the embodiment of FIG. 5.

DESCRIPTION OF AN ILLUSTRATIVE EMBODIMENT OF THE INVENTION

Figure 1:
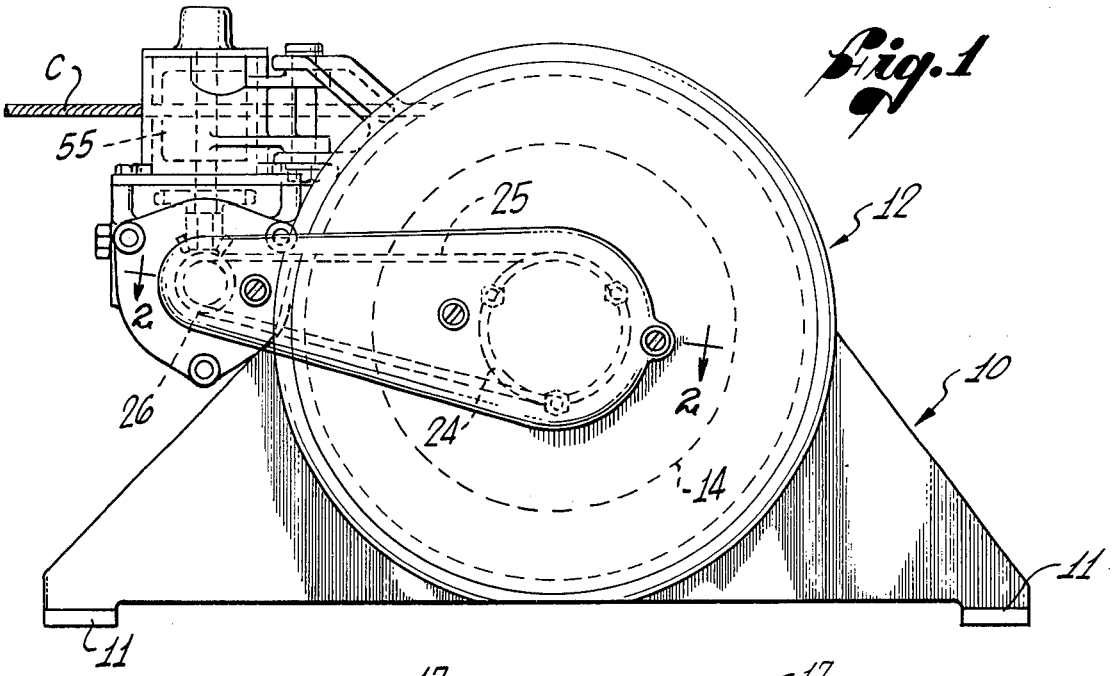
FIG. 1 is a side elevational view of an illustrative embodiment of the invention in its application as a winch for paying out or retrieving a cable in a generally horizontal direction.
Figure 2:
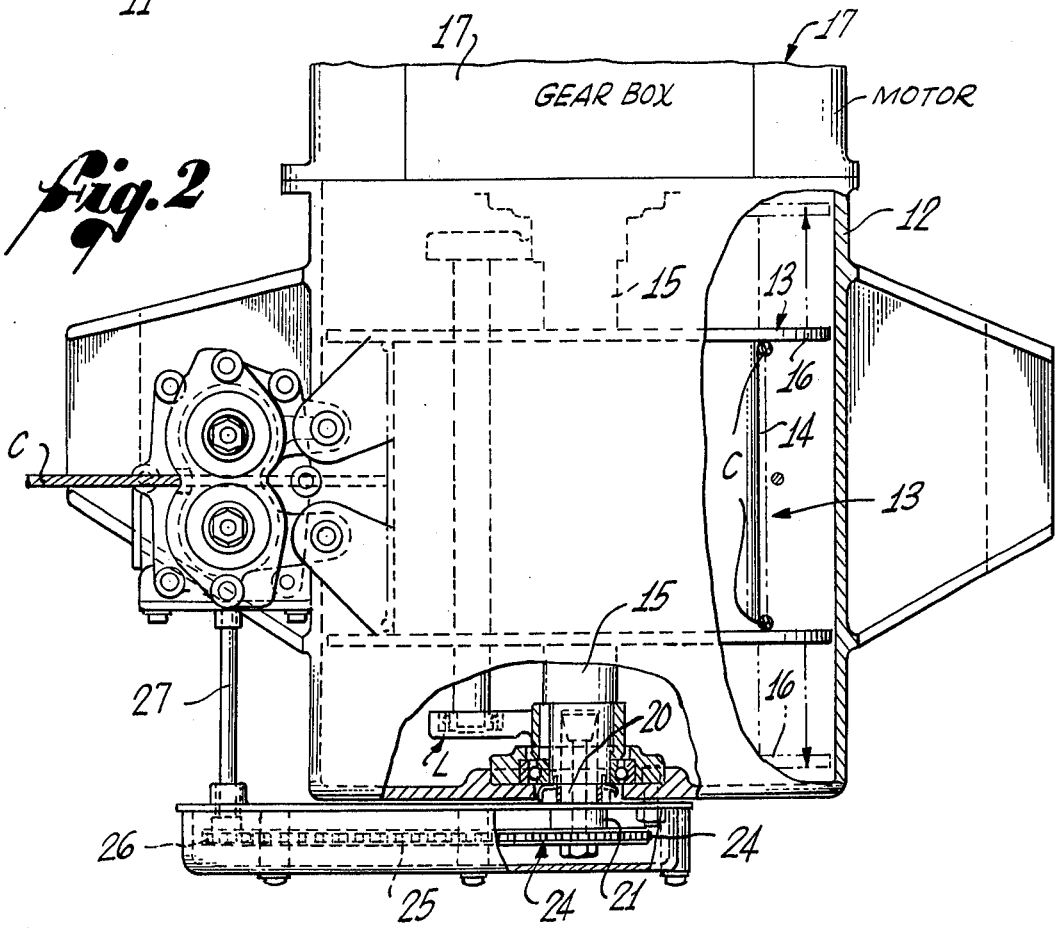
FIG. 2 is a top plan view of FIG. 1, parts being broken away on section line 2—2 of FIG. 1.

In FIGS. 1 to 3 of the drawings, numeral 10 designates a support frame, with feet at 11 for mounting on a horizontal support. The frame 10 merges with a cable drum housing 12, arranged to accommodate a reel or cable winding drum 13 rotatable on a horizontal axis. The drum 13 has end flanges 16 and a hub or cylinder 14. The drum is mounted and splined to an axial drum shaft 15 driven by a power means, typically a hydraulic motor, with suitable reduction gearing, not shown, in a motor and gear housing 17. In FIG. 2, the drum is shown in full lines in a center position. Through conventional means, the drum is continuously axially translated back and forth along the drum shaft 15, between the two end limiting positions indicated in phantom lines in FIG. 2, and by this means the point of runoff and return of the cable relative to the reel is maintained in a fixed position, notwithstanding the fact that this point, relative to the oscillating, drum, reciprocates axially. In FIG. 2, the actuating means for this motion is partially suggested at L, but since such devices are well known in the art, and in any event form no part of the present invention, no illustration thereof is deemed necessary herein.

Coupled to the right-hand end of the drum shaft 15 is a drum shaft extension 20, on the extremity of which is fastened the hub 21 of a chain sprocket 24. The latter is connected by chain 25 to a smaller sprocket 26 (1 to 3 step-up drive ratio), which is on one extremity of a shaft 27, whose other extremity (FIG. 3) drives a bevel gear 28 through a conventional spring actuated friction disk slip clutch generally designated at 30. The bevel gear 28 is on a stub shaft 31 mounted in the traction roller housing 32, which is secured to the main or cable drum housing 12. Thus the slip clutch 30 transmits torque up to the limit set by the clutch spring 35 and the frictional resistance developed by the interengaging surfaces of the friction disks as shown in FIG. 3, beyond which slippage occurs within the clutch.

The slip clutch 30 may take any suitable form, as known in the art, but here comprises an internal gear 36, pinned on the extremity of shaft 27. Gear 36 drives a gear 37, which also has axial play relative to gear 36, and gear 37 has bearing on a hub of a friction disk 38 supported on and keyed to a sleeve 39, pinned on the hub of gear 28, and which in turn abuts a snap ring 39' engaging into a groove in a cylinder **39*a* having stub shaft extensions 31 and 39*c* supported as shown. The aforementioned gear 28 is fast on the shaft extension 31. Belleview washer spring 35 on the sleeve 39 engages a friction disk 39*e* which is keyed on sleeve 39, and the spring presses the disk 39*e* against the gear 37, and the gear 37 against friction disk 38. The gear 37 can be bronze, and the disks 38 and 39*e***, made of steel, to create the necessary friction, and frictional slip properties; or thin friction washers can be used at the frictional interfaces.

The aforementioned bevel gear 28 meshes with a bevel pinion 40 on the lower extremity of a roller shaft 41, giving a step-up drive ratio, and the lower portion of shaft 41 carries a spur gear 42 which meshes with a larger spur gear 43 (step-down drive ratio) on the lower extremity of a roller shaft 44 parallel to the roller shaft 41.

Encircling the two roller shafts are two over-running or one-way roller clutches 45 and 46, respectively, of any suitable or conventional type, or any equivalent; whose drive directions will be mentioned presently; and around and cooperating with these one-way clutches are cylindrical hubs 47 and 48, respectively, of cable engaging traction rollers 55. The outer portions of these rollers comprise relatively thick hollow cylinders 56 of a relatively soft elastomeric abrasion-resistant material, e.g., Neoprene rubber, or polyurethane, or a hardness of the order of Shore A 70. The peripheries of these elastomeric rollers are preferably in tangential engagement. The cable C which is to run therebetween becomes deeply, and preferably totally, embedded into the elastomeric cylinders, in a positive non-slip manner, as though it were geared. The hubs 47 and 48 of the traction rollers bear at their extremites equal-diameter, intermeshing spur gears 58, such that the traction rollers are synchronized to rotate in opposite directions in unison.

The one-way cluth 45 is designed to drive its corresponding traction roller when its shaft 41 is driven clockwise from gear 42 on shaft 41 (looking downward in FIG. 3), and the one-way clutch 46 is designed to drive its traction roller when its shaft 44 is driven counterclockwise by its gear 43. Thus, during paying out, one-way clutch 46 simply overruns while shaft 41 is driving its corresponding traction roller through clutch 45, and retards the right traction roller during reeling in, at a speed governed by the size of gear 43, while one-way clutch 45 over-runs.

Operation is as follows:

Assume first that the drum is just beginning to unwind cable. Bear in mind that the gripping action of the synchronized soft elastomeric rollers on the cable prevents slippage between cable and rollers. Therefore, roller speed is always a function of cable and drum speed. Any slippage in the system owing to differences in drum drive and roller drive speed of the cable occur automatically in the slip clutch.

The overall drive ratio of the system for reeling out is made such that, at the beginning of reeling out, positive cable traction speed occurs at the traction rollers at the largest diameter of cable wrap on the drum, because of higher tangential velocity for any given drum speed (R.P.M.). In other words, drive ratio from the drum shaft through the slip clutch (assumed not to slip) to the traction rollers, is made such that there is a tendency to over-drive the traction rollers at this time (beginning of reeling out, with cable diameter on drum at its maximum). Slippage within the slip-clutch must therefore occur. This slippage will then grow as the cable wrap diameter on the drum is reduced.

In reeling in cable, the effective drive ratio is such, at the smallest diameter of cable wrap on the drum, and with the gear 43 now effective in the system, as to provide a retarding traction, i.e., a holding back on the cable (pulling away from the drum). These two extremes are satisfied by the two gears 42 and 43 which drive the roller shafts 41 and 44, it being recalled that the gear 42 is of smaller diameter than the gear 43. In driving the traction rollers 55 in the "reel out" direction, the roller shaft 41 with the smaller gear 42 drives its corresponding roller 55 through the one-way roller clutch 45 inside this roller. As viewed looking from the top in FIG. 3, this one-way clutch drive of the left-hand traction roller 55 is in a clockwise direction. The right-hand traction roller is then driven in unison in the opposite direction by meshing gears 58. The one-way clutch 46 does not drive in this (counterclockwise) direction of rotation of the roller shaft 44. The right-hand roller shaft 44 is over-running its one-way roller clutch 46 at this time because its hub is running ahead (faster) due to the step-down shaft gear ratio from gear 42 to gear 43.

In the reel-in direction, the roller shaft 44 with the large gear 43 is driving (actually holding back) its roller 55 through the one-way roller clutch 46 inside said roller 55. The other (left-hand) roller 55 is again driven by the meshing roller hub gears 58 and is over-running its roller clutch 45 because its shaft 41 is running ahead (faster) due to the roller shaft gear ratio.

The aforementioned bevel gears 28, 40 driven through the slip clutch, drive the roller gears and provide the additional gear ratio required to make the traction roller tangential velocity match that of drum and cable wrap tangential velocity (cable speed).

The varying outside cable layer diameter on the drum and resulting tangential velocity as the cable is paid out, or retrieved, is accommodated by having sufficient overall ratio in the drive for each direction, and by the slip clutch which slips at a rate compatible with the diameter of a given outside cable layer. The percentage slip may vary, for example, from 5 to 25 percent in each direction. The traction force in a present illustrative embodiment of the invention can be adjusted within a range of 5 to 25 pounds cable tension.

In FIGS. 5 and 6 are schematically shown an application of the invention to the case of a hoisting or cable winding drum 70 in the base 71 of a boom 72 which is here shown as mounted on a support at 73. The extremity of the boom mounts a sheave S over which the cable C travels to hang downwardly therefrom, in this case shown as suspending a hook 74 which may carry a load (not shown) to be lifted or lowered. The hoisting drum 70 may be regarded as the same as the winch of the first-described embodiment, and may also be advantageously powered by a hydraulic motor, though other types of motor may be used. The shaft 75 of the drum 70 is coupled by a mechanical transmission, including preferably a flexible drive shaft represented at 77, to drive an input worm gear 78 meshing with a worm wheel 80. This worm wheel 80 is on a shaft 81 rotatable on a fixed axis, and carrying two dissimilar sized spur pinions 82, in mesh with idler spur gears 83 meshing with spur gear disks 85 rotatable on the axis of a sheave mounting shaft 86. Gear disks 85 have bearing on the hubs of pressure disks 86, and are axially backed up or supported on sleeves 88 by snap rings as indicated. The opposite sides of disks 86 are in frictional engagement with the confronting faces of gear disks 85, and pressure disks 89 keyed on sleeves 88 ar actuated by springs 90 as in the first described embodiment. One-way roller clutches 92 and 93 are contained inside and operate in the sleeves 88, in a manner analogous to that of the first embodiment, the only difference being relocation inside the sleeves 88 instead of the traction rollers of FIGS. 1–3*a*.

Sheave 95 is mounted on shaft 86, and has a preferably 60° angle layer 96 of elastomeric material in its cable groove. Spring pressed rollers 98 hold the cable tightly in the V-groove of the elastomeric layer on the sheave to furnish the non-slip property between the sheave and cable. Gear ratio and cable wrap diameter considerations are as in the embodiment of FIGS. 1–3, and need not be repeated for the physical reorganization of FIGS. 4 and 5, which discloses only a modified arrangement in which a sheave replaces the traction rollers of FIGS. 1 and 3, along with certain reorganization of conponent parts, but without departure from the basic concept inherent in FIGS. 1–3. The two drive ratios, which automatically come into play during and in response to paying out and retrieving of the cable are provided for in the two trains of gears on opposite sides of the sheave, as can be observed in FIG. 6. Gear ratios are thereby established in correspondence to those accomplished by the gears 42 and 43 in the embodiment of FIGS. 1–4.

What is claimed is:

1. An apparatus for preventing fouling of cable on a power driven cable drum during paying out and reeling in cable, said drum having a powered drive shaft;

roller means adapted for non-slipping engagement with a cable running alternately off and onto said cable drum, a transmission intercoupled between said powered drive shaft for driving said roller means reversely in cable paying out and retrieving directions as the drum pays out and retrieves cable, friction slip clutch means in said transmission, said transmission also including a one-way clutch adapted to positively drive said roller means in the direction to pay out cable, and another one-way clutch adapted to hold back on said roller means in the direction to retrieve cable, and said transmission having an automatically selective gear means responsive to the direction of cable drive providing one drive ratio such as to over-drive the said roller means during cable pay-out, at a large cable wrap diameter on the drum, and a different drive ratio to under-drive said roller means during reeling in, at a low cable wrap diameter on the drum, said friction slip clutch accommodating drive ratio change while said roller means maintains non-slipping engagement with the cable.

2. The subject matter of claim 1, wherein said roller means comprises a pair of rollers on parallel axes, whose peripheries receive and grip therebetween the cable from said cable drum, said rollers being geared together to rotate in unison but in opposite directions, the outer peripheries of said rollers being arranged for frictional non-slip engagement with the cable.

3. The subject matter of claim 1, wherein said roller means comprises a pair of rollers on parallel axes, whose peripheries receive and grip therebetween the cable from said cable drum, said rollers being geared together to rotate in unison but in opposite directions, each of said rollers having a peripheral layer of an elastomeric material, the outer peripheries of the rollers being spaced apart by a distance substantially less than cable diameter and said elastomeric material being soft enough for relatively deep depression of the cable passing therebetween into its outer periphery, such as to provide a virtually non-slip engagement between rollers and cable.

4. The subject matter of claim 1, wherein said roller means comprises a sheave with a peripheral cable groove in which the cable from said cable drum is received, and spring-actuated means for pressing said cable into non-slip engagement into said cable groove of said sheave.

5. The subject matter of claim 4, wherein the cable groove of said sheave contains a layer of elastic material formed with a V-groove to snugly receive the cable in the bottom thereof and of a softness to indent substantially in response to tension in the cable passing therearound, whereby to provide a virtually non-slip engagement between sheave and cable.

6. The subject matter of claim 3, with said friction slip clutch means located in said transmission between said power drive shaft of said cable drum and said one-way clutch means, and with said selective gear means located between said slip clutch means and said one-way clutch means.

7. The subject matter of claim 4, with said friction slip clutch means located in said transmission between said power drive shaft of said cable drum and said one-way clutch means, and with said selective gear means locatad between said slip clutch means and said one-way clutch means.

* * * * *